United States Patent [19]

Broman

[11] 4,349,158

[45] Sep. 14, 1982

[54] PROCESS AND DEVICE FOR WET MILLING OF ROCKS AND THE LIKE

[76] Inventor: John S. Broman, Bergslagsvägen 12, S-777 00 Smedjebacken, Sweden

[21] Appl. No.: 183,795

[22] Filed: Sep. 4, 1980

Related U.S. Application Data

[63] Continuation of Ser. No. 33,079, Apr. 25, 1979, abandoned.

[30] Foreign Application Priority Data

May 2, 1978 [SE] Sweden ..... 7805001

[51] Int. Cl.[3] ..... B02C 15/00

[52] U.S. Cl. ..... 241/21; 241/24; 241/41; 241/46.04; 241/46.15; 241/117

[58] Field of Search ..... 241/21, 24, 29, 30, 241/46.02, 46.04, 46.15, 41, 117–122

[56] References Cited

U.S. PATENT DOCUMENTS 281,511 7/1883 Howland ..... 241/284 X

FOREIGN PATENT DOCUMENTS 1228167 4/1971 United Kingdom ..... 241/117

*Primary Examiner*—Mark Rosenbaum

*Attorney, Agent, or Firm*—Pollock, Vande Sande & Priddy

[57] ABSTRACT

A process, as well as a device for carrying out same, for grading-separating wet milling of rocks and the like in a mill having a vertical rotational shaft, a milling chamber widening downwards and outwards from a central outlet and one or more milling rollers interacting with the milling chamber, the replenishment of the pulp being done through constant feed. The pulp volume is regulated by displacing the upper edge of the outlet vertically, whereby control of the milling time is achieved so that particles can be kept a longer or shorter time in the milling chamber depending on the milling resistance and structure of the material fed in, thereby effecting a control according to particle type for continued milling of particles which are not completely milled, for example mineral-containing particles, and for discharging from the milling chamber completely milled particles and mineral grains. In the device, the milling chamber is separable from the central outlet at a selected height by means of a regulating member, for example a vertically adjustable shield. The device is provided with at least one wave dampener controlling and active in the surface layer of the pulp. The dampener is preferably a screen or water curtain.

8 Claims, 3 Drawing Figures

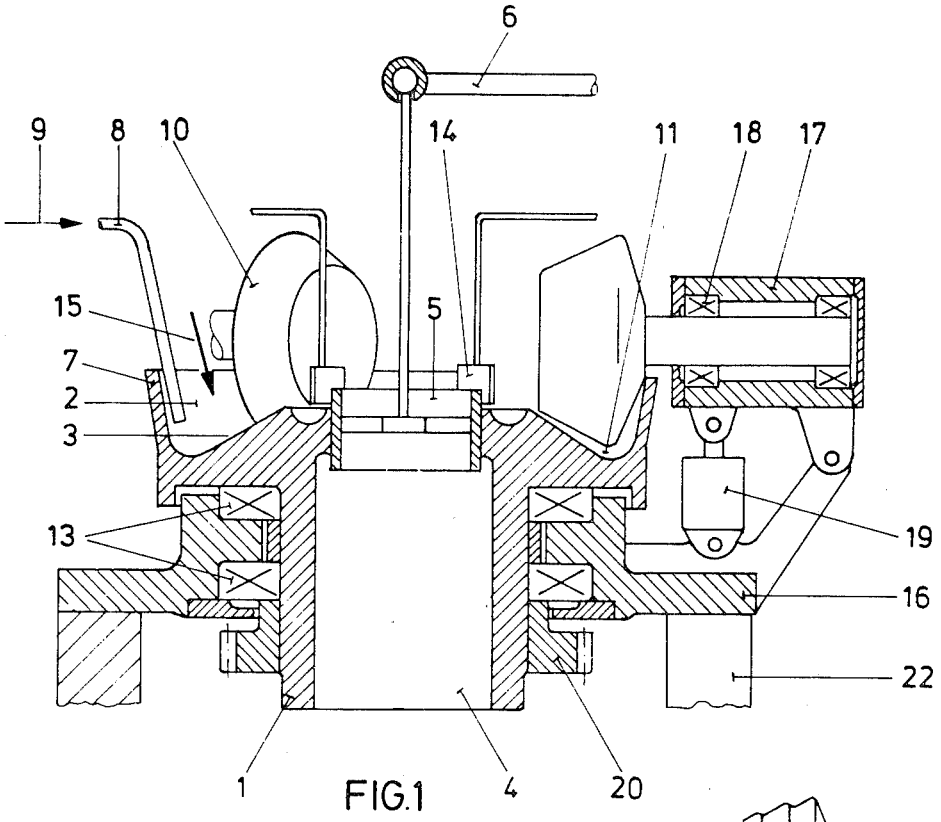
FIG.1
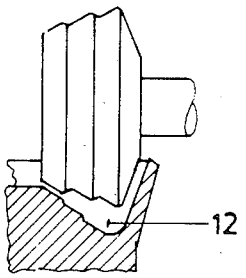
FIG.2
FIG.3
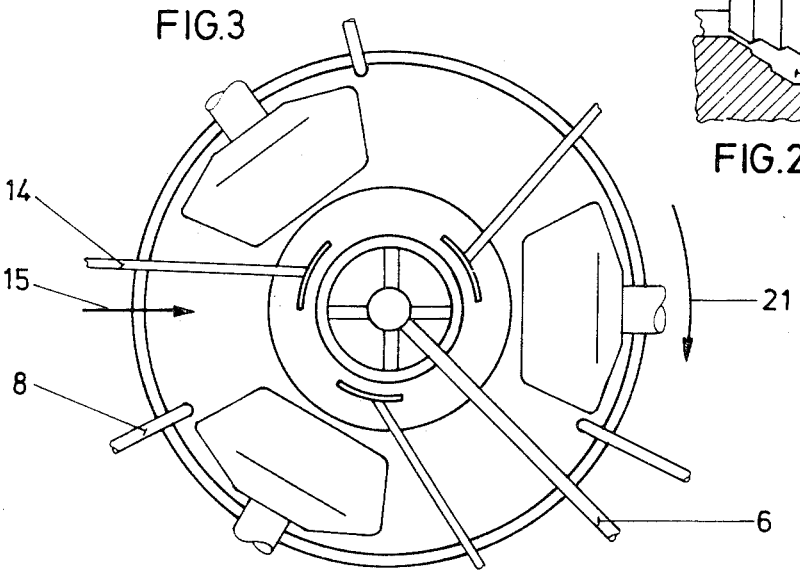

PROCESS AND DEVICE FOR WET MILLING OF ROCKS AND THE LIKE

STATEMENT OF RELATED APPLICATIONS

This is a continuation of U.S. application Ser. No. 33,079, filed Apr. 25, 1979 now abandoned.

The present invention relates to an energy conserving process for breaking down rocks and the like by roller milling in combination with grading and separation of milling materials in the milling chamber.

The drum mill is now predominant in the field of wet milling. In this type of mill a large portion of the energy supplied goes to waste as a result of geometrically determined, random movement which is partially negative, and by the abrasion caused by this movement.

When the milling material is subjected to abrasion, small fragments are broken off which, due to their low mass, cannot be caught in the subsequent process step, but accompany the process water out as a loss, especially when dealing with precious minerals, causing environmental problems. Particles which have already achieved the desired fineness are subjected to further milling since the feed-out proceeds independently of the particle dimensions. This creates an amount of much too fine particles, resulting in a loss of energy, wear metals and valuable minerals, as well as environmental problems.

According to the invention, the milling is done between members which have similar movement in the active milling sections of a milling chamber in which the throughput time for the milling material, and therefore the degree of milling, can be regulated, and in certain cases particles with low density can be separated out.

For reasons of cost and efficiency, rational planning attempts to achieve functionally correct sub-proceses which, with the minimum number of steps possible, provide the required breaking down of coarse materials supplied to a finished product, with a size distribution providing optimum mineral yield or otherwise, makes the finished product suitable for the manufacture of building materials, for example.

In a pulp consisting of crushed rock and water, for example, there occur, under certain conditions, both a sizing or grading according to particle size and a separation according to density of the solid portion of the mixture. In a suitably arranged milling chamber, there exists, according to the present invention, the basis for exploiting both the grading and the separation effect to optimize the economy of the milling process.

By selecting in a mill which includes several active milling units, different crushing degrees for the different units and through an incrementally narrowing gap, a total degree of reduction can be achieved which with conventional crushing-milling methods requires several machine units with auxiliary equipment, with large space requirements.

Since replenishment of the pulp at constant feed takes longer the greater the volume is, raising the outlet edge of the milling chamber means that the particles will be subjected to a greater number of milling phases so that they will be milled to a greater degree before leaving the milling chamber. Lowering the outlet edge of the milling chamber reduces the pulp volume and speeds up the throughput of the milling material with fewer milling phases and a lower degree of milling. By controlling the pulp volume, the milling work according to the invention can be easily adapted to the milling resistance or to the desired degree of milling, as dictated by variations in the fed-in material. In a mill where the milling is intended to free the mineral grains from the non-metalliferous gangue, light gangue particles are lifted to the surface by the heavier metalliferous particles. By suitable guiding and dampening of the wave formation occurring in the vicinity of a milling roller, these just-mentioned lower density particles, whose mineral content or composition do not require further milling, are guided out over the outlet edge. Freeing the milling chamber in this manner, at an early stage, of non-metalliferous particles saves energy and wear metals while at the same time increasing the real capacity of the mill since milling can be directed to the mineral containing particles which require milling to expose the minerals.

The invention is described below with reference to examples shown in the accompanying drawing of a device for carrying out the process according to the invention. In the drawing, FIG. 1 shows a vertical section through the device;

FIG. 2 shows an alternative embodiment of the roller and the milling surface; and FIG. 3 shows a plain view of the device according to FIG. 1.

The milling process can be used in a mill which is shown by way of illustration in the accompanying drawing. As can be seen in FIG. 1, the mill has a vertical rotational shaft 1, a milling chamber 2 with a conical, downwardly-outwardly inclined milling surface 3, a central outlet 4 with, for example, a sealing slide 5 which can be positioned vertically by means of an operating member 6, an outer limiting wall 7 for the milling chamber 2, one or more (three in the example shown) means 8 for supplying process water 9, and three preferably conical rollers 10 cooperating with the milling surface 3. The gap 11 formed between the active members, i.e., the milling surface 3 and the rollers 10, can, for example, be of constant width or wedge-shaped as seen in cross section in FIG. 1, or have an upwardly incrementally narrowing width 12 as shown in FIG. 2. In order for the mill to grip coarse particles, the roller 10 which first comes into contact with fed-in material should be somewhat elevated, thus forming a relatively wide gap 11,12 there. One or more suitably placed baffles or screens 14 or the like, for example water curtains, can prevent the formation of waves and dampen disruptive waves on the surface of the pulp and facilitate or guide the movement of coarse particles which due to low density float to the surface of the pulp, so that they are deflected from the milling chamber 2 over the outlet edge at 6.

The rotational movement required for the milling work is applied from an electric or hydraulic motor (not shown) to the milling chamber unit consisting of rotational shaft 1, milling surface 3 and limiting wall 7, via gears 20 or the like. If required, one or more of the milling rollers 10 can be driven. The milling chamber unit 1,3,7 is guided by bearings 13 in a frame 16. Milling material is supplied to the milling chamber according to the arrow 15. For readjustment of the gaps 11,12 and for protection against overload, the milling rollers 10 with associated bearing housings 17 and bearings 18 are swingably journalled on the frame 16. With the aid of a device 19, for example a piston-cylinder device, it is possible to keep the size of the gap 11,12 at a desired dimension in spite of wear on the milling surface 3 and rollers 10, and furthermore to determine the magnitude of the maximum force applied to the milling surface and rollers and bearings when the passage of an uncrushable object lifts the milling rollers 10. A foundation 22 supports the mill with associated driving means.

FIG. 3 shows how rollers 10, baffles or screens 14 and the supply of fresh material according to the arrow 15 and process water 9 through the pipe means 8 can be arranged when the milling chamber unit 1,3,7 rotates in the direction of the arrow 21.

The milling proceeds as follows. The fresh material is supplied at the arrow 15 and process water 9 under suitable pressure is supplied, preferably behind each milling roller 10. After a coarse particle has been moved against a milling roller 10 and been crushed in the relatively wide portion of the gap 11,12, newly formed fine particles are lifted upwards by the tubulance formed behind the roller 10, and by the upward flow which the water 9 introduced via the means 8 produces in the direction against the upper edge of the outlet at 5, as well as by the effect of the coarser particles which, by the interaction between gravity and centrifugal force caused by the rotation of the mill, move outwards and downwards along the milling surface 3. Newly formed particles which require further crushing-milling are moved by coarser particles successively higher up along the milling surface 3 towards a narrower and narrower portion of the gap 11,12 where they are milled to the desired fineness. During this entire process, sufficiently fine particles are separated from coarser ones through the effect of turbulence, supplied water and insufficiently milled sinking particles, said separated fine particles being thereby lifted towards the surface and leave the milling chamber over the upper edge of the adjustable outlet 5. Since the grading in a slurried pulp is done so that the finest particles float in the surface layer and the particle size increases with the depth from the surface, it follows that by adjusting the vertical position of the outlet edge, keeping the flow-through constant, it is possible to move the separation limit for particle size, since the surface layer down to a certain depth in a high pulp contains fewer coarser particles than the surface layer with the same depth in a low pulp. Particles with low density are lifted regardless of size up to the surface of the pulp, are drawn there by the flow in the surface layer to the outlet and exit from the milling chamber.

Due to the fact that chrushing-milling according to the idea of the invention proceeds in a bottom layer which primarily contains coarse particles, remilling of fine particles is avoided.

Separating out particles of low density from the milling chamber avoids milling which is technically and economically disadvantageous.

Use of the proceeds described here provides a simple flow diagram with few machine units with low costs for planning, installation and environmental protection. Energy consumption, wear and mineral losses are also reduced.

What I claim is:

1. Process for grading-separating wet milling of rocks and pieces of ore in a mill having a vertical rotatable shaft and a central outlet through said shaft, a milling chamber annularly surrounding said shaft and having a bottom comprising a milling surface inclined radially outwards and downwards from an upper edge of said outlet, at least one milling roller interacting with said milling chamber, comprising the steps of (a) feeding material to be milled into said milling chamber;

(b) grinding said milling material into a pulp between said at least one milling roller and said milling chamber;

(c) causing insufficiently ground material to slide downwardly along said milling surface to prolong its engagement between said at least one milling roller and said milling chamber;

(d) regulating the volume of said pulp by displacing vertically the position of the upper edge of said central outlet in relation to both the rest of said shaft and said milling surface; and (e) adjusting the duration of milling to the milling resistance and structure of said material, thereby effecting continued milling of insufficiently milled particles and discharge from said milling chamber through said central outlet of sufficiently milled particles and mineral grains.

2. Process according to claim 1, including adjusting the distance between said at last one roller and said milling chamber.

3. Mill for grading-separating wet milling of rocks and pieces of ore, comprising (a) a vertical rotatable shaft with a central outlet passage through said shaft, said outlet passage having an upper portion comprising an inlet end;

(b) a milling chamber which annularly surrounds an upper end of said shaft, said milling chamber having a bottom which constitutes a milling surface which extends radially out from the shaft and is inclined outwards and downwards from an upper edge of said outlet passage;

(c) at least one milling roller interacting with said milling chamber and cooperating with said milling surface;

(d) limit means within the inlet end of said outlet passage and axially displaceable relative to said shaft; and (e) means for changing the position of the limit means relative to said milling surface.

4. Mill according to claim 1, wherein said limit means comprises a vertically adjustable annular separating wall displaceably mounted at the upper end of said shaft, said separating wall having an upper edge forming a sill-like outlet edge between said milling chamber and said upper portion of said outlet passage.

5. Mill according to claims 3 or 4, comprising at least one wave dampener controlling and active in a surface layer of said material being milled.

6. Mill according to claim 5, wherein said wave dampener is a screen.

7. Mill according to claim 5, wherein said wave dampener is a water curtain.

8. Mill according to claim 3, comprising means for adjusting the distance between said at least one roller and said milling chamber.

* * * * *